US012181199B1

(12) United States Patent
Personna

(10) Patent No.: US 12,181,199 B1
(45) Date of Patent: Dec. 31, 2024

(54) COOLER WITH DRY STORAGE COMPARTMENT

(71) Applicant: Daniel Personna, Port St Lucie, FL (US)

(72) Inventor: Daniel Personna, Port St Lucie, FL (US)

( * ) Notice: Subject to any disclaimer, the term of this patent is extended or adjusted under 35 U.S.C. 154(b) by 0 days.

(21) Appl. No.: 17/577,999

(22) Filed: Jan. 18, 2022

(51) Int. Cl.
*F25D 11/02* (2006.01)

(52) U.S. Cl.
CPC ..... *F25D 11/02* (2013.01)

(58) Field of Classification Search
CPC ..... F25D 11/02
See application file for complete search history.

(56) References Cited

U.S. PATENT DOCUMENTS 2,030,005 A * 2/1936 Kellogg ..... F25D 3/125 62/394
2,363,530 A * 11/1944 Iwashita ..... F25D 11/02 62/287
2,645,332 A * 7/1953 Martin ..... F25D 3/08 220/592.01
4,286,440 A 9/1981 Taylor
5,129,238 A * 7/1992 Schwartz ..... F25D 31/007 220/904
5,590,542 A * 1/1997 Wang ..... F25D 3/08 62/457.3
5,609,039 A * 3/1997 Green ..... F25D 3/08 62/529
6,341,491 B1 * 1/2002 Paine ..... F25B 17/08 62/380
6,574,983 B2 * 6/2003 Smith ..... F25D 3/14 62/372
6,688,135 B1 * 2/2004 Mattia ..... F25D 3/08 62/457.2
6,698,230 B1 * 3/2004 Brusky ..... F25D 3/08 62/529
7,013,670 B2 * 3/2006 Gonzalez ..... F25D 3/14 62/384
7,107,783 B2 * 9/2006 Smolko ..... A45F 3/20 62/316
7,178,673 B1 * 2/2007 Miller ..... A45C 11/20 206/545
7,260,944 B2 * 8/2007 Anthony ..... F25D 3/107 62/77

(Continued)

FOREIGN PATENT DOCUMENTS

DE 202016102615 U1 * 9/2017 ..... B65D 83/76

*Primary Examiner* — Filip Zec
(74) *Attorney, Agent, or Firm* — Sanchelima & Associates, P.A.; Jesus Sanchelima; Christian Sanchelima

(57) ABSTRACT

A cooler assembly including an ice chest assembly and a receptacle assembly. The ice chest assembly includes an insulating container having a rectangular shape. The container has an opening that is covered by a lid. The lid is hingedly attached to one edge of the opening. The container includes handles attached to sides of the container. The receptacle assembly includes a tubular receptacle being extended through the interior of the cooler from one lateral side to another lateral side. The tubular receptacle has threaded ends to receive threaded caps. The threaded caps removably cover openings of the receptacle. The tubular receptacle has a dry and cool interior.

9 Claims, 6 Drawing Sheets

(56) References Cited

U.S. PATENT DOCUMENTS

| | | | | |
|---|---|---|---|---|
| 7,614,512 | B2 * | 11/2009 | Nader | B65D 51/24 206/217 |
| 7,861,552 | B1 * | 1/2011 | Hughes | A45C 13/02 62/457.2 |
| 9,360,248 | B1 | 6/2016 | Efferding | |
| 11,433,349 | B1 * | 9/2022 | Anthony | F25D 5/02 |
| 11,745,913 | B1 * | 9/2023 | Spence | B65D 81/3227 215/6 |
| 2005/0066682 | A1 * | 3/2005 | Anthony | F25D 3/107 62/293 |
| 2010/0308057 | A1 * | 12/2010 | Hart | B65D 51/285 220/506 |
| 2012/0269025 | A1 * | 10/2012 | Liu | B01F 27/2122 366/129 |
| 2014/0124512 | A1 * | 5/2014 | Diaz | A47G 19/30 220/574 |
| 2019/0152679 | A1 * | 5/2019 | Park | B65D 1/22 |

* cited by examiner

COOLER WITH DRY STORAGE COMPARTMENT

BACKGROUND OF THE INVENTION

1. Field of the Invention

The present invention relates to a cooler and, more particularly, to a cooler that includes a dry storage compartment.

2. Description of the Related Art

Several designs for coolers have been designed in the past. None of them, however, include an insulated container with a receptacle extending through the interior of the container.

Applicant believes that a related reference corresponds to U.S. Pat. No. 9,360,248 issued for a portable beverage cooler having an outer portion for ice and an inner cylinder for receiving a beverage cup. Applicant believes that another related reference corresponds to U.S. Pat. No. 4,286,440 issued for a cooler having an internal dry storage compartment. None of these references, however, teach of a cooler with dry storage compartment including an insulated rectangular container having a tubular receptacle extending through the interior of the cooler, the receptacle has threaded caps on each end which are accessible from the exterior of the container.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a cooler with dry storage compartment that includes a tubular receptacle that is easy to install to an insulated bin to storage items such as food, personal items or the like.

It is another object of this invention to provide a cooler with dry storage compartment that includes an insulating container to store items such as beverages, ice, or the like.

It is another object of this invention to provide a cooler with dry storage compartment that keeps the stored items dry and cool.

It is still another object of the present invention to provide a cooler with dry storage compartment that is portable.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
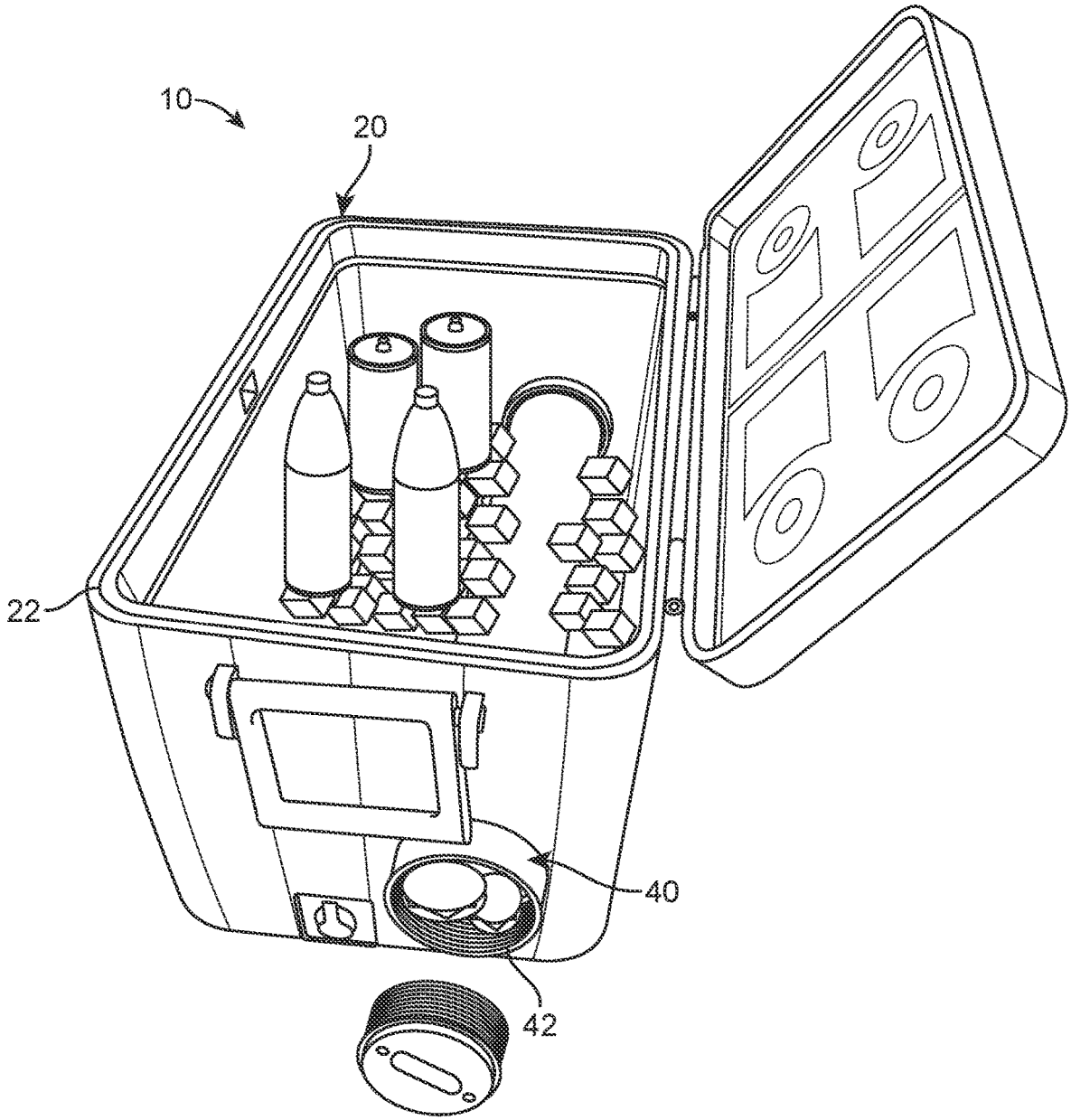
FIG. 1 represents an isometric operational view of the present invention 10 showing beverages stored on interior of container 22. Receptacle 42 is opened and receives food isolated from wet of interior of container 42.

Referring now to the drawings, where the present invention is generally referred to with numeral 10, it can be observed that it basically includes ice chest assembly 20 and receptacle assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The ice chest assembly 20 includes an ice chest 21 having a container 22 and a lid 24. In one embodiment, container 22 may have a front wall 22*a*, a left wall 22*b*, a right wall 22*c*, a rear wall 22*d* and a bottom wall 22*e*. In one embodiment, bottom wall 22*e* may have a substantially rectangular shape. Other embodiments for the bottom wall 22*e* may have a circular shape, rectangular shape with rounded corners oval shape, elliptical shape, triangular shape, pentagonal shape, trapezium shape, hexagonal shape, irregular shape, or any other suitable shape. A left edge of the bottom wall 22*e* is connected to left wall 22*b*. Left wall 22*b* may be perpendicular to the bottom wall 22*e*. It also may be suitable to have the left wall 22*b* having an inclination respect to bottom wall 22*e*. Preferably, the left wall 22*b* may have a substantially rectangular flat shape. It also may be suitable to have the left wall 22*b* having a rectangular shape with rounded edges, trapezium shape, a curved cross-sectional shape, an irregular shape or any other suitable shape. A right edge of the bottom wall 22*e* is connected to the right wall 22*c*. Right wall 22*c* may be perpendicular to the bottom wall 22*c* and parallel to the left wall 22*b*. It also may be suitable to have the right wall 22*c* having an inclination respect to bottom wall 22*e*. Preferably, the right wall 22*c* may have a substantially rectangular flat shape. It also may be suitable to have the right wall 22*c* having a rectangular shape with rounded edges, trapezium shape, a curved cross-sectional shape, an irregular shape or any other suitable shape.

Rear wall 22*d* may be connected to a rear edge of the bottom wall 22*e* and to one edge of the left wall 22*b* and to an edge of the right wall 22*c*. Rear wall 22*d* may be perpendicular to the bottom wall 22*e* and perpendicular to left wall 22*b* and perpendicular to the right wall 22*c*. It also may be suitable for the rear wall 22*d* to have an inclination. In one embodiment, rear wall 22*d* may have a substantially rectangular flat shape. The rear wall 22*d* may also have a trapezium shape, an irregular shape, or any other suitable shape. Front wall 22*a* may be connected to bottom wall 22*e* and to left wall 22*b* and to right wall 22*c*. Front wall 22*a* may be parallel and opposite to rear wall 22*d*. Front wall 22*a* may be perpendicular and adjacent to left wall 22*b* and to right wall 22*c*. Front wall 22*e* may have a rectangular shape, a trapezium shape, a hexagonal shape, an irregular shape, a curved shape, or any other suitable shape.

Ice chest assembly 20 may further include first handle 26 and second handle 26*a*. In one embodiment, handle 26 and second handle 26*a* may be defined by four bars perpendicularly connected one to each other. It also may be suitable to have first handle 26 and second handle 26*a* defined by any other combinations of structures or shapes. First handle 26 and second handle 26*a* may be made of a hard plastic, a metal with coating or any other suitable resistant material. First handle 26 may be hingedly connected to a middle top portion of left wall 22*b*. Second handle 26 may be hingedly connected to a middle top portion of right wall 22*c*. Right wall 22*c* may further include a water dispenser 28 located on a bottom portion. Ice chest 21 may be made of an insulating material such a combination of but not limiting to plastic, hard foam, refrigerating gel or any other material with high thermal insulation properties. It should be understood that ice chest 21 may be any kind of ice chest 21 and have any size.

Receptacle assembly 40 may include receptacle 42. In one embodiment receptacle 42 may have an elongated cylindrical shape. It also may be suitable to have receptacle 42 with other cross sectional shape such as rectangular shape, oval shape, triangular shape, irregular shapes, helicoidal shape or any other shape suitable to define an elongated receptacle. Receptacle 42 may be entirely hollow or have separated sections. Receptacle 42 may include left end 42*a* and right end 42*b* opposite one to each other and providing access to interior of receptacle 42. Left end 42*a* may include an interior side having a first threaded portion 44. Right end 42*b* may include an interior side having a second threaded portion 44*a*. Receptacle 42 may have a slightly bigger length than large of container 22. Receptacle 42 may be made of polyvinyl chloride, a hard plastic, or any other solid thermal insulating material.

Receptacle 42 may be extended through interior of ice chest from a bottom portion of left wall 22*b* to a bottom portion of right wall 22*c*. It also may be suitable to have receptacle 42 partially incorporated to ice chest. It may be suitable to incorporate receptacle 42 into any ice chest. It also may be suitable to mold the receptacle 42 to incorporate receptacle 42 in manufacturing ice chest. Receptacle assembly 40 further includes caps 46. Caps 46 may have a cylindrical shape or any other shape. Caps 46 may have an exterior surface with cap threaded portion 46*a*. Each cap 46 may cooperate with first threaded portion 44 and second threaded portion 44*a* to removably seal receptacle 42. Receptacle 42 may provide an isolated dry compartment for ice chest 20 to avoid that stored items such as food get wet. Referring now to FIG. 1, it can be observed that interior of container 42 may have ice to maintain cold temperature of interior of container. It may be suitable to store items such beverages into container. Food or items that could be damage with water or wet may be stored into receptacle 42.

Figure 2:
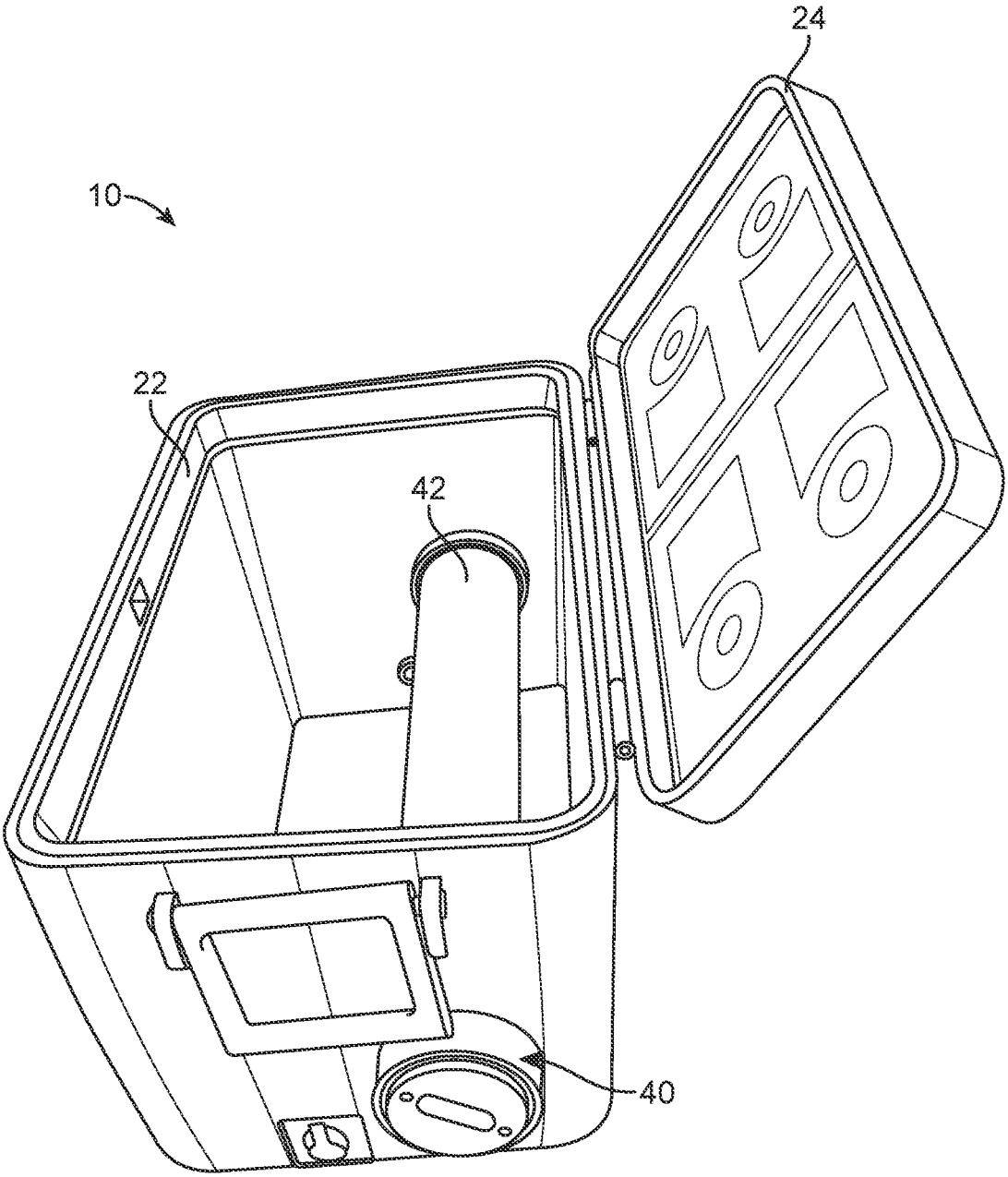
FIG. 2 shows an isometric right view of the present invention 10 with the receptacle assembly 40 in a closed configuration.
Figure 2A:
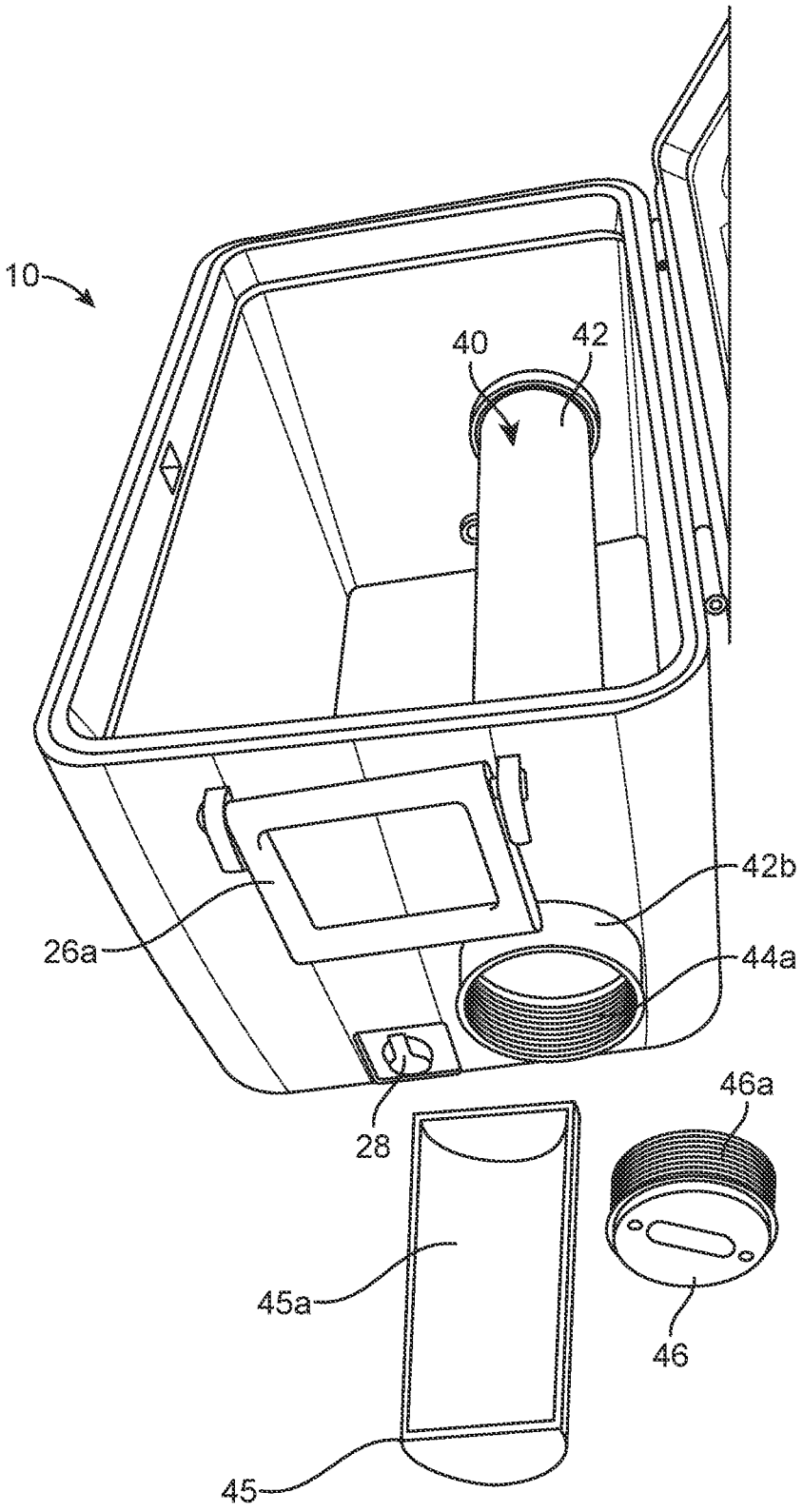
FIG. 2A shows an isometric enlarged right view of the present invention 10 showing the receptacle assembly 40 in an opened configuration.
Figure 3:
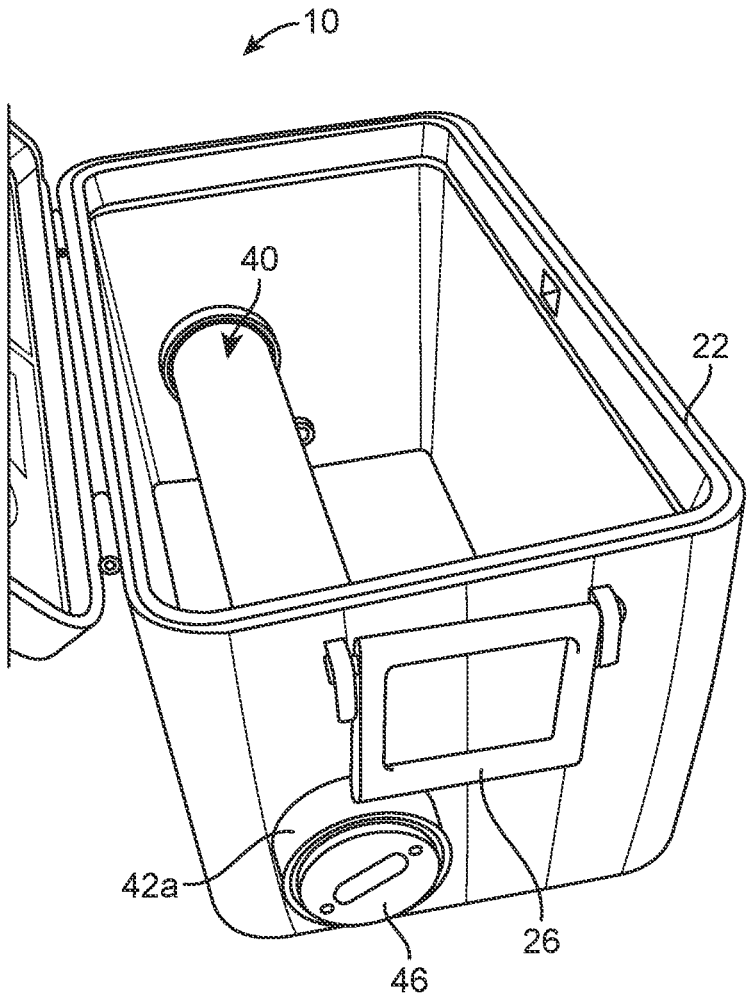
FIG. 3 illustrates an isometric left side of the present invention 10 showing the receptacle 40 in a closed configuration.
Figure 3A:
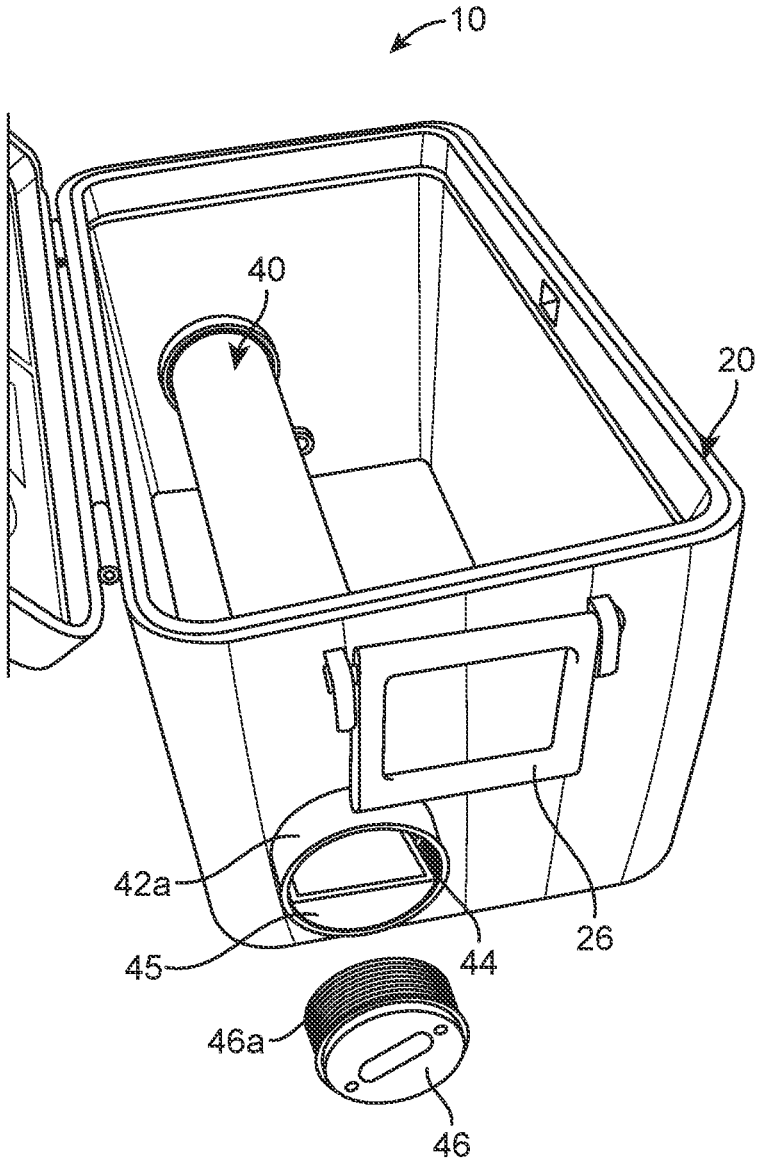
FIG. 3A illustrates an isometric left side of the present invention 10 with the receptacle assembly 40 in an open configuration
Figure 4:
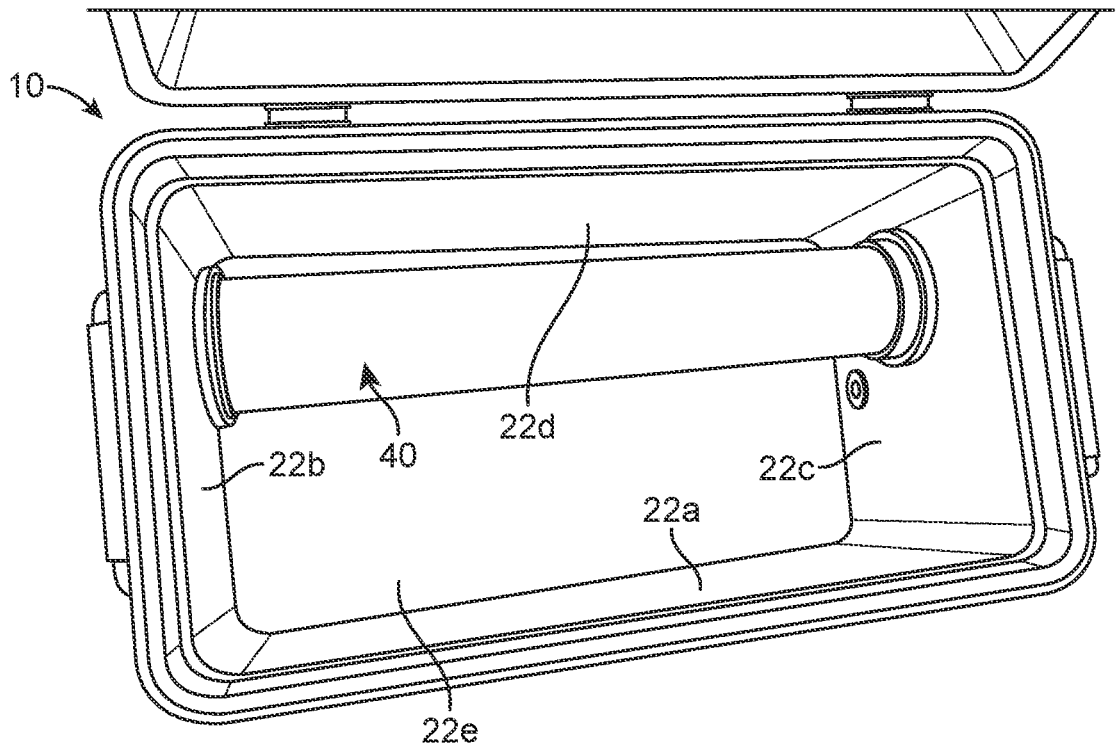
FIG. 4 is a representation of a top view of the present invention 10 showing interior of container 22 having receptacle 42 mounted from left wall 22*b* to right wall 22*c*.

Best observed in FIGS. 2*a* and 3*a*, the receptacle assembly 40 further may include a tray 45. In one embodiment the tray 45 may have a first tray end and a second tray end with a semicircular shape. It should be understood that the first tray end and the second tray end may have any other suitable shape such as a rectangular shape, an oval shape, a triangular shape, an elliptical shape or the like. A bottom portion of the first end may be connected by a tray channel 45*a*. The tray channel 45*a* may be entirely concave defining a tray 45 with a semi cylindrical shape with an opening on the top portion. The opening of the tray 45 may receive sunglasses, cellphones, wallets, keys, cameras, food or any other item that a user wants to preserve cool and dry. Tray 45 may be a sliding tray. Tray 45 may be slidably received by the receptacle 42. Tray 45 may have a slightly smaller diameter than the receptacle 42 so the tray 45 may fit into the receptacle 42. Tray 45 may have same length as the receptacle 42 or smaller lengths. It also may be suitable to have additional trays with a smaller length to be received by the receptacle 42.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cooler with dry storage compartment, comprising:

a. an ice chest assembly including an ice chest, said ice chest is a cuboid-shaped container and a lid hingedly attached at a top side of the container, said container includes handles located on lateral sides of container, thus providing portability to said ice chest, wherein said ice chest assembly further includes a water dispenser located on a right wall of the container; and b. a receptacle assembly including a receptacle and a tray, said receptacle with a tubular shape extends through the interior of the ice chest, wherein said receptacle has a length larger than the container allowing a first end of the receptacle to protrude from a first wall of the container and a second end of the receptacle to protrude from a second wall of the container, said receptacle is an isolated dry compartment, said tubular receptacle has openings at a left end and a right end thereof with a threaded portion, to receive threaded caps respectively, wherein the tray is a sliding tray with a same length as the receptacle, wherein the tray has a half cylinder shape cut along a longitudinal axis, said tray is slidably received by the receptacle.

2. The cooler with dry storage compartment set forth in claim 1, wherein said left end and said right end of said receptacle extend past from the left wall to said right wall of the container.

3. The cooler dry storage compartment set forth in claim 1 wherein said tray has a tray top opening defining a tray channel.

4. A cooler with dry storage compartment, comprising:

a. an ice chest assembly including an ice chest, said ice chest is a cuboid-shaped container and a lid, said lid is hingedly attached at a top side of the container, said container includes handles located on lateral sides of container, thus providing portability to said ice chest, wherein said ice chest assembly further includes a water dispenser located on a right wall of the container; and b. a receptacle assembly including a receptacle with a tubular shape, said receptacle includes a first distal end and a second distal end, said first distal end has a first interior side with a first threaded portion, said second distal end has a second interior side with a second threaded portion, wherein said receptacle has a length larger than the container allowing the first distal end of the receptacle to protrude from a first wall of the container and the second distal end of the receptacle to protrude from a second wall of the container, said receptacle is an isolated dry compartment, said receptacle extends through the interior of the ice chest, said receptacle assembly further includes caps, said caps has an exterior threaded portion to cooperate with said first threaded portion and said second threaded portion for sealing said receptacle, said receptacle assembly further including a tray slidably received by said receptacle, wherein the tray is a sliding tray with a same length as the receptacle.

5. A cooler with dry storage compartment, consisting of:

a. an ice chest assembly including an ice chest, said ice chest is a cuboid-shaped container and a lid, said lid is hingedly attached to the container, said container includes handles located on lateral sides of container, thus providing portability to said ice chest said container assembly further includes a water dispenser located on one of lateral sides of container; and a receptacle assembly including a receptacle, said receptacle has an elongated tubular shape, said receptacle includes a first distal end and a second distal end, said first distal end has a first interior side with a first threaded portion, said second distal end has a second interior side with a second threaded portion, wherein said receptacle has a length larger than the container allowing the first distal end of the receptacle to protrude from a first wall of the container and the second distal end of the receptacle to protrude from a second wall of the container, said receptacle is an isolated dry compartment, said receptacle extends through the interior of the ice chest from a left lateral wall to a right lateral wall, said receptacle assembly further includes caps, said caps have a circular shape, said caps has an exterior threaded portion to cooperate with said first threaded portion and said second threaded portion for sealing said receptacle, said receptacle assembly further including a tray, said tray has a semicylindrical shape with a tray top opening, said tray is a sliding tray, said tray is slidably received by said receptacle wherein the sliding tray has a same length as the receptacle.

6. The cooler dry storage compartment set forth in claim 3, wherein said semicylindrical shape has a diameter that conforms with a diameter of said receptacle, said tray is capable of being slit in and slit out from said receptacle.

7. The cooler dry storage compartment set forth in claim 1, wherein said tray includes lateral walls, wherein said tray with said tray channel is adapted to preserve cool and dry any suitable item.

8. The cooler dry storage compartment set forth in claim 1, wherein said handles are hindgedly connected to a middle top portion of said lateral sides of said container.

9. The cooler dry storage compartment set forth in claim 1, wherein said receptacle is made of a thermal insulating material.

* * * * *